US006152063A

United States Patent [19]

Niemier

[11] Patent Number: 6,152,063

[45] **Date of Patent: *Nov. 28, 2000**

[54] SIT-ON-TOP KAYAK

[75] Inventor: Timothy A. Niemier, Bellingham, Wash.

[73] Assignee: Old Town Canoe Co., Old Town, Mass.

[ * ] Notice: This patent is subject to a terminal disclaimer.

[21] Appl. No.: 09/415,187

[22] Filed: Oct. 7, 1999

Related U.S. Application Data

[63] Continuation of application No. 08/557,436, Nov. 14, 1995, Pat. No. 5,964,177, which is a continuation-in-part of application No. 29/045,310, Oct. 16, 1995, abandoned, which is a continuation of application No. 29/020,506, Mar. 25, 1994, Pat. No. Des. 377,473, which is a continuation-in-part of application No. 29/011,308, Aug. 2, 1993, abandoned.

[51] Int. Cl.[7] ..... B63B 35/00

[52] U.S. Cl. ..... 114/347; 114/363

[58] Field of Search ..... 114/347, 363, 114/291; D12/300, 302, 313, 316

[56] References Cited

U.S. PATENT DOCUMENTS

| | | | |
|---|---|---|---|
| D. 319,211 | 8/1991 | Kruse . | |
| D. 322,774 | 12/1991 | Arcouette . | |
| D. 341,351 | 11/1993 | Arcouette | D12/302 |
| D. 391,916 | 3/1998 | Masters . | |
| D. 400,155 | 10/1998 | Masters . | |
| 3,584,590 | 6/1971 | Rings et al. . | |
| 4,106,143 | 8/1978 | Lucas . | |
| 4,378,747 | 4/1983 | Beatty et al. . | |
| 4,407,216 | 10/1983 | Masters . | |
| 4,480,579 | 11/1984 | Masters . | |
| 4,520,747 | 6/1985 | Masters . | |
| 4,583,480 | 4/1986 | Hamilton et al. . | |
| 4,589,365 | 5/1986 | Masters . | |
| 4,660,490 | 4/1987 | Broadhurst . | |
| 4,710,143 | 12/1987 | Boulanger . | |
| 4,715,311 | 12/1987 | Masters . | |
| 4,744,327 | 5/1988 | Masters . | |
| 4,820,216 | 4/1989 | Masters . | |
| 4,942,840 | 7/1990 | Masters et al. . | |
| 4,945,852 | 8/1990 | Kobayashi . | |
| 4,980,112 | 12/1990 | Masters . | |
| 5,042,416 | 8/1991 | Arcouette | 114/347 |
| 5,076,194 | 12/1991 | Curtis et al. . | |
| 5,094,607 | 3/1992 | Masters . | |
| 5,134,964 | 8/1992 | Masters . | |
| 5,189,974 | 3/1993 | Masters . | |
| 5,367,975 | 11/1994 | Hamilton et al. . | |
| 5,397,525 | 3/1995 | Niemier . | |
| 5,406,904 | 4/1995 | Kobayaski . | |
| 5,493,982 | 2/1996 | Carpenter et al. . | |
| 5,540,176 | 7/1996 | Galea . | |
| 5,855,180 | 1/1999 | Masters . | |
| 5,964,177 | 10/1999 | Niemier | 114/347 |
| 5,970,903 | 10/1999 | McDonough et al. . | |

FOREIGN PATENT DOCUMENTS

| | | | |
|---|---|---|---|
| 2673416A1 | 9/1992 | France . | |
| 2686055 | 7/1993 | France | 114/363 |
| 424910 | 2/1926 | Germany . | |
| 7903845 | 11/1980 | Netherlands | 114/347 |
| 2172553 | 9/1986 | United Kingdom . | |
| WO 99/06272 | 11/1999 | WIPO . | |

OTHER PUBLICATIONS

Scupper Pro Product Brochure, Ocean Kayak, Inc.
Scrambler Product Brochure, Ocean Kayak, Inc.
Zuma Two Product Brochure, Ocean Kayak, Inc.
Paddler, Selected pages from Jul. 1992 Issue.

*Primary Examiner*—Ed Swinehart
*Attorney, Agent, or Firm*—Michael R. Schacht; Hughes & Schacht, P.S.

[57] ABSTRACT

A sit-on-top kayak having a seating and footwell arrangement that allows three people to sit comfortably in a cockpit of the kayak. Three seating surfaces and footwells are preferably employed. The footwells associated with the two rearmost seating surfaces straddle the two forwardmost seating surfaces. An improved hull is provided having a keel and winglets extending on either side of the keel. The keel and winglets terminate at the front in a bow portion of the hull lower surface and come together at a point at the stern of the kayak.

27 Claims, 6 Drawing Sheets

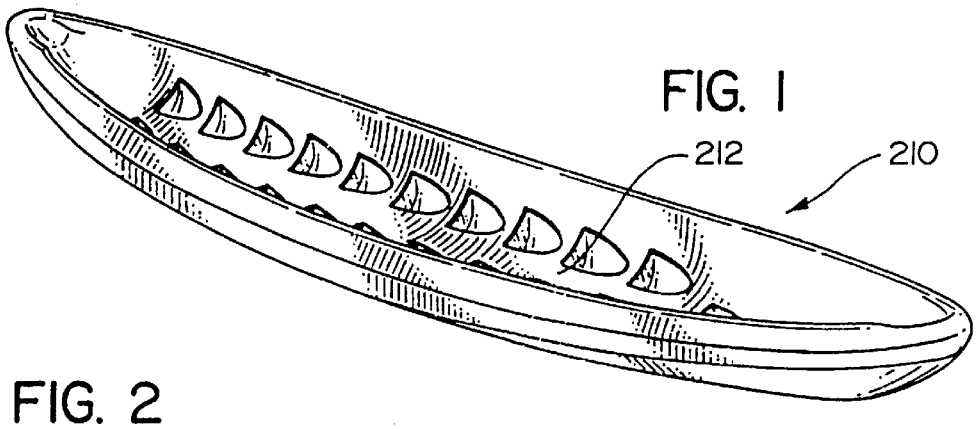
FIG. 1
FIG. 2
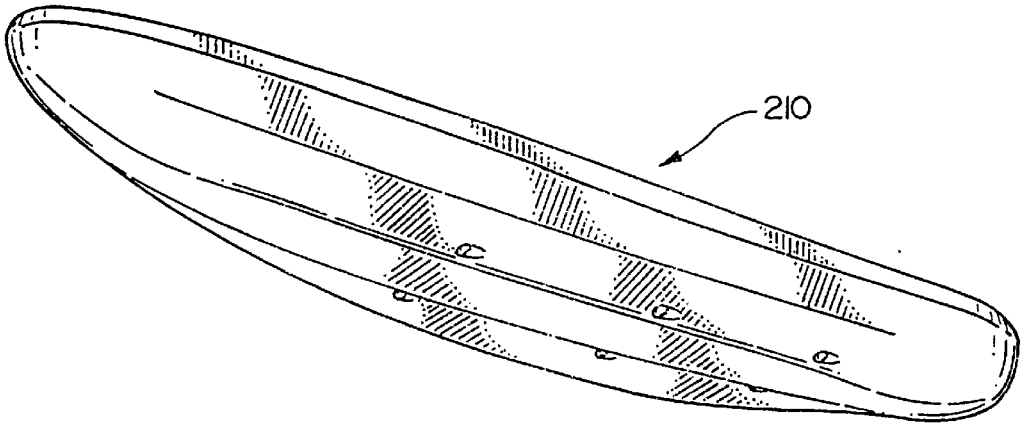
FIG. 3
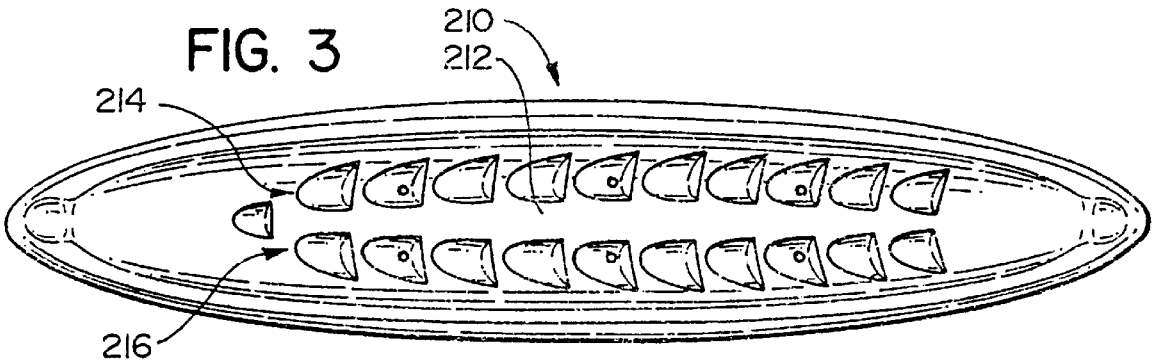
FIG. 4
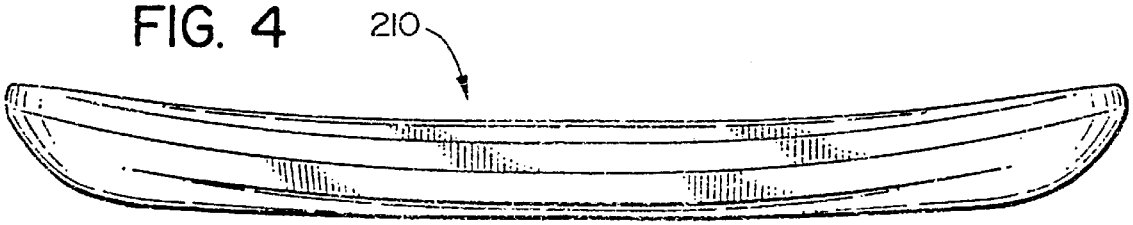

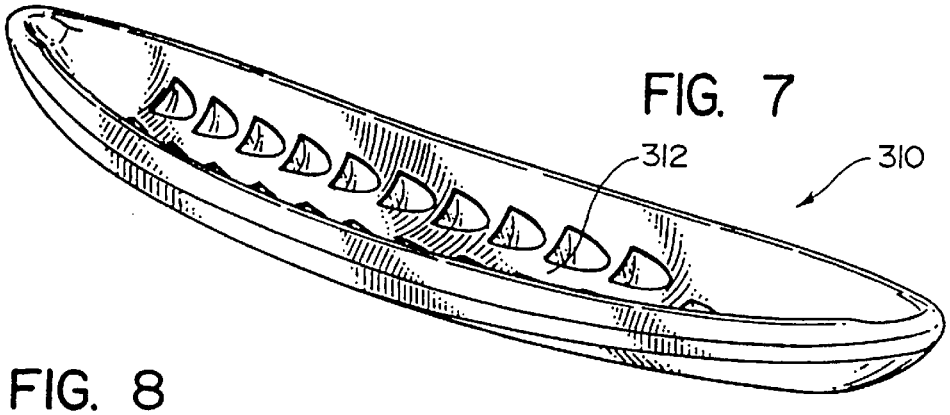
FIG. 7
FIG. 8
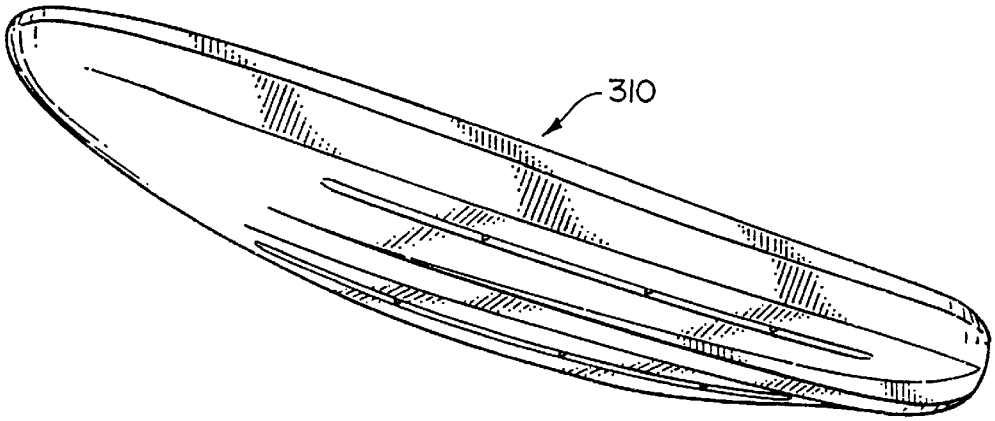
FIG. 9
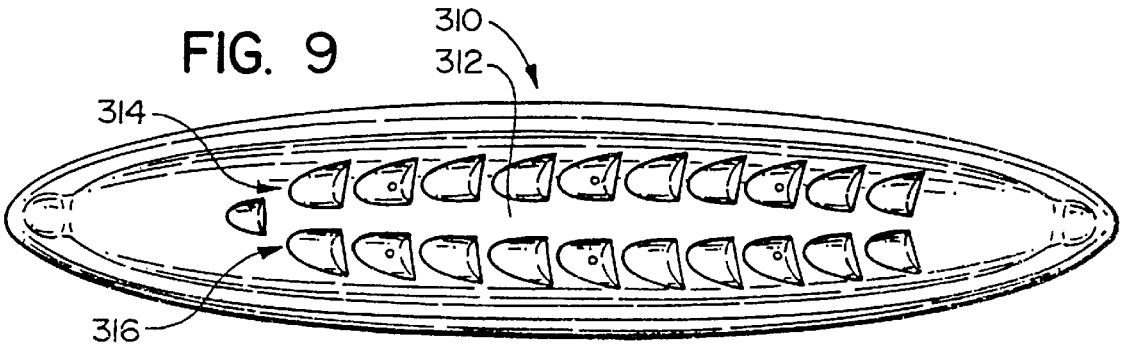
FIG. 10
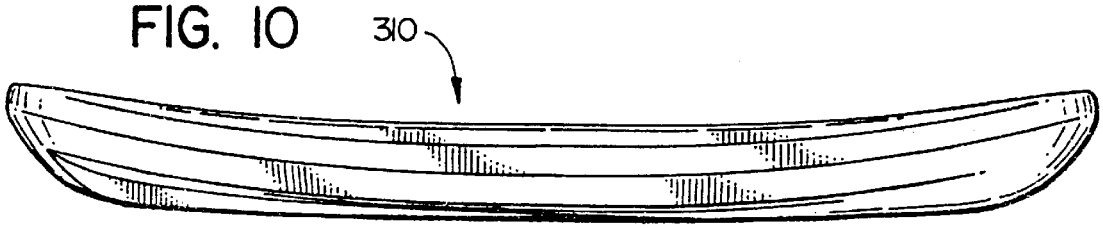

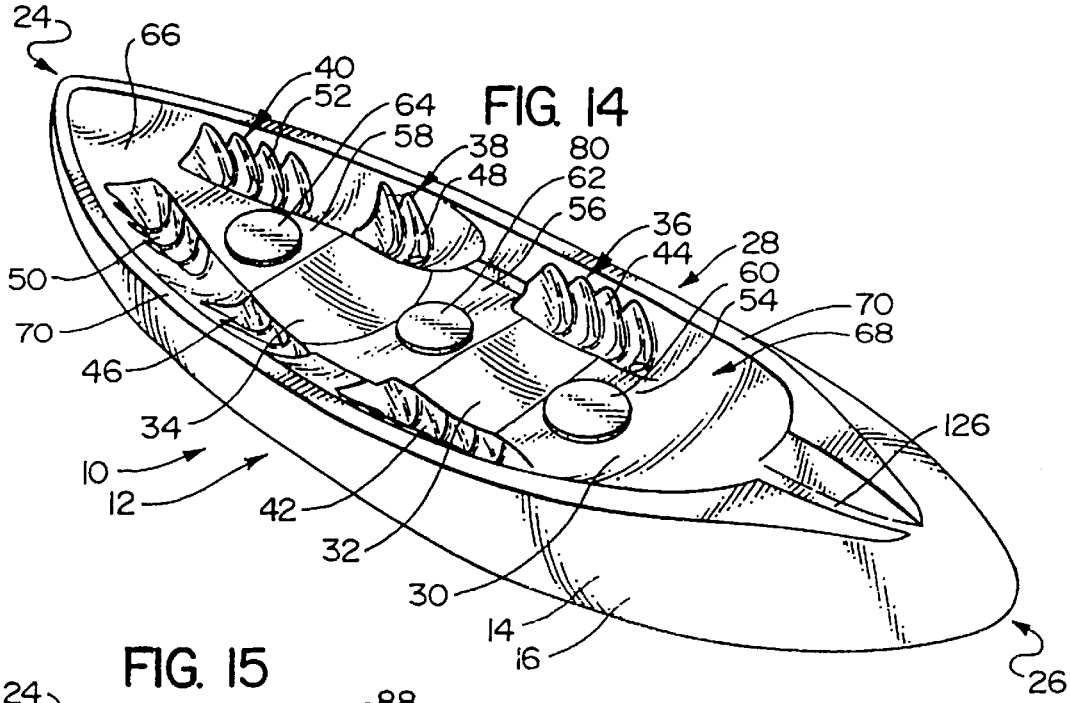
FIG. 14
FIG. 15
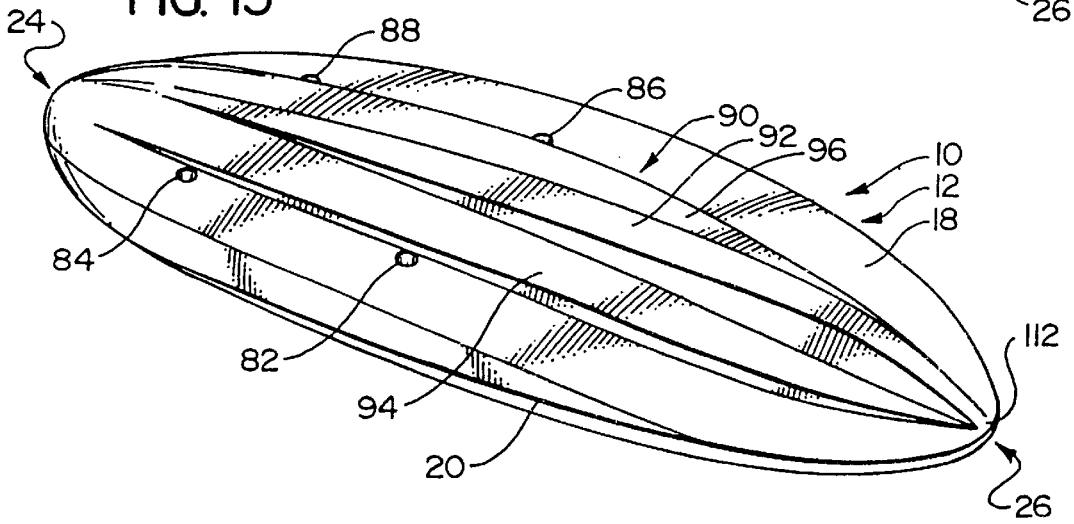
FIG. 16
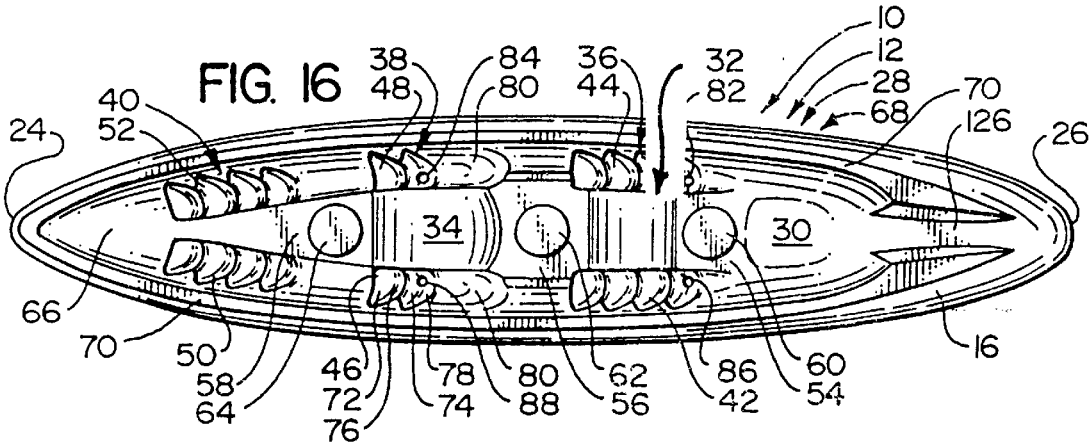

SIT-ON-TOP KAYAK

RELATED APPLICATIONS

This is a continuation of application Ser. No. 08/557,436 filed Nov. 14, 1995, now U.S. Pat. No. 5,964,177, which is a continuation-in-part of application Ser. No. 29/045,310 filed Oct. 16, 1995, abandoned which is a continuation of application Ser. No. 29/020,506 filed Mar. 25, 1994, now U.S. Pat. No. Des. 377,473, which is a continuation-in-part of application Ser. No. 29/011,308 filed Aug. 2, 1993, abandoned.

TECHNICAL FIELD

The present invention relates to human propelled water craft such as kayaks and canoes and, more particularly, rotationally molded sit-on-top kayaks having open cockpits.

BACKGROUND OF THE INVENTION

Conventional kayaks comprise a hollow shell in which the kayaker's lower body and legs are received through an opening in the shell. These kayaks require a certain amount of skill to operate as the kayaker must learn to "self-rescue", or roll the kayak into an upright position if the kayak is tipped over.

An alternative type of kayak has been developed and has gained increasing acceptance. This new type of kayak is referred to in the industry and herein as a sit-on-top kayak. As this name suggests, the user of a sit-on-top kayak sits in an open cockpit on top of the kayak hull. The sit-on-top kayak is somewhat similar to a surfboard in overall shape, but normally has a generally V-shaped hull portion and a deeper draft to allow better tracking. Modern sit-on-top kayaks are conventionally formed out of polyethylene using a rotational molding process to obtain a sealed, hollow shell. The process of manufacturing rotationally-molded polyethylene sit-on-top kayaks is generally discussed in U.S. Pat. No. 5,397,525 issued to the present Applicant.

The kayak discussed in the aforementioned '525 patent is a single seat kayak designed for use by one person. A seating surface, footwell, and hatch surface are formed in the cockpit of the kayak shown in the '525 patent. The Applicant is also aware of a number of two-person kayaks in which two seating surfaces and footwells are provide. A comfortable, stable three-person kayak has been difficult to manufacture, however, because the overall length of the boat becomes impractical.

The need thus exists for a sit-on-top kayak design that provides three seating surfaces and footwells associated therewith, but does not result in a boat that is inconveniently long.

OBJECTS OF THE INVENTION

From the foregoing, it should be clear that one primary object of the present invention is to provide an improved sit-on-top kayak design.

A further object of the invention is to provide a sit-on-top kayak having a favorable combination of the following characteristics:

(a) minimizes the overall length of the kayak;

(b) allows three people to sit therein comfortably;

(c) may be operated by one person;

(c) may easily be manufactured by the rotational molding; and (d) is stable and comfortable.

As will become clear from the following detailed discussion, these and other objects are achieved by the sit-on-top kayak configuration of the present invention.

SUMMARY OF THE INVENTION

These and other objects are obtained by a sit-on-top kayak having a seating and footwell arrangement that allows three people to sit comfortably in a cockpit of a kayak. Inside the cockpit, three seating surfaces and footwells are formed. The footwells associated with the two rearmost seating surfaces are each divided into two footwell portions that straddle the two forward seating surfaces.

This configuration allows the distances between the seating surfaces to be reduced to the minimum required to prevent interference with normal paddling motion. The minimum possible distance defined by normal paddling motion is less than the amount of room required between the seating surface and the forwardmost portion of the footwell associated therewith. By placing a forward seating surface between portions of a footwell associated with a seating surface immediately therebehind, more persons can be comfortably seated in a boat of a given length, which makes practical a boat designed for three people.

The present invention also employs an improved hull having a keel extending partly from the stern to the bow and winglets laterally extending on either side of the keel. The keel and winglets terminate towards the front in a bow portion of the hull lower surface and come together at a point at the stern of the kayak. The keel and winglets allow the boat to track well when going in a forward direction, but the fact that the keel does not extend all the way to the bow makes it easier to turn the craft when required.

BRIEF DESCRIPTION OF THE DRAWINGS

FIG. 1 is an isometric view of a first embodiment of a water craft of the present invention, taken from an upper side end location;

FIG. 2 is an isometric view of the first embodiment of my water craft taken from a position below and to one side thereof;

FIG. 3 is a top plan view of the first embodiment;

FIG. 4 is a side elevational view of the first embodiment;

FIG. 7 is an isometric view of a second embodiment of a water craft of the present invention, taken from an upper side end location;

FIG. 8 is an isometric view of the second embodiment of my water craft taken from a position below and to one side thereof;

FIG. 9 is a top plan view of the second embodiment;

FIG. 10 is a side elevational view of the second embodiment;

FIG. 14 is an isometric view of a third embodiment of a water craft of the present invention, taken from an upper side end location;

FIG. 15 is an isometric view of the third embodiment of my water craft taken from a position below and to one side thereof;

FIG. 16 is a top plan view of the third embodiment;

DETAILED DESCRIPTION

Figure 5:
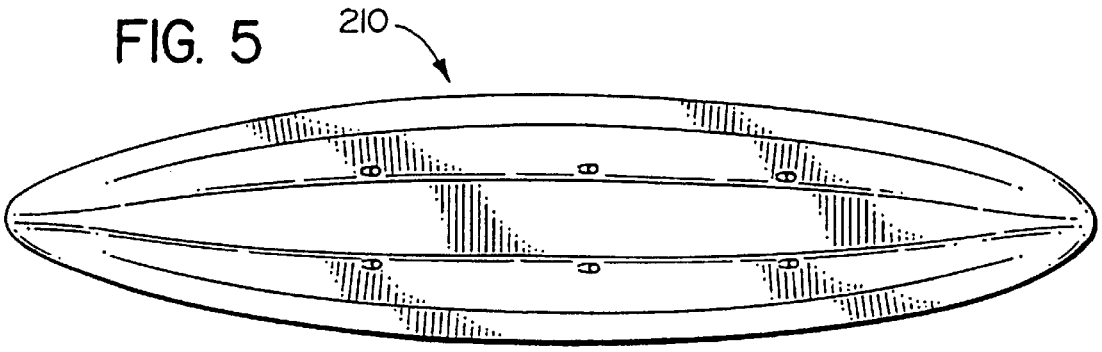
FIG. 5 is a bottom plan view of the first embodiment.
Figure 6:
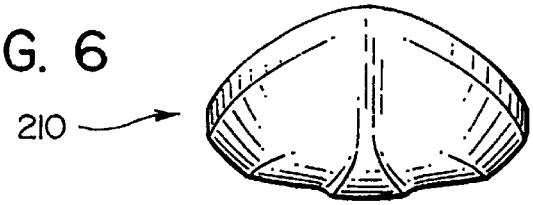
FIG. 6 is an elevational view of an end of the first embodiment of my water craft.
Figure 11:
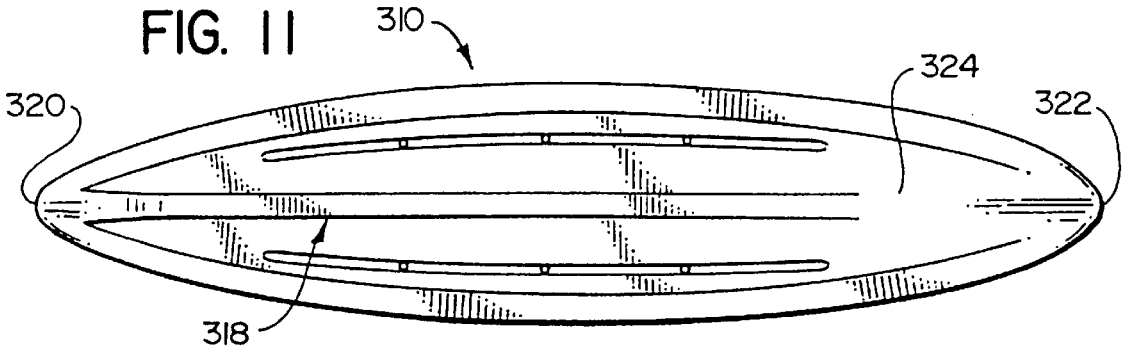
FIG. 11 is a bottom plan view of the second embodiment.
Figure 12:
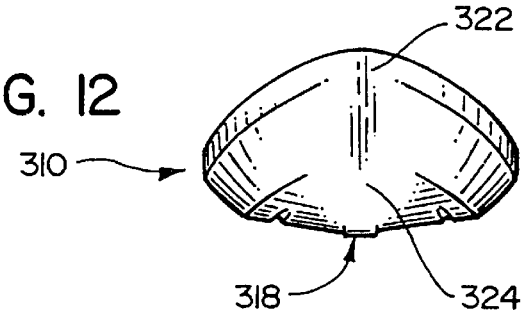
FIG. 12 is an elevational view of a first end of the second embodiment of my water craft.
Figure 13:
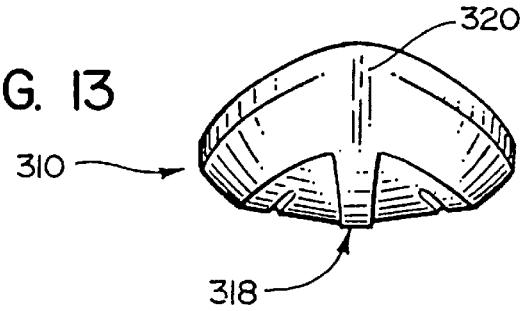
FIG. 13 is an elevational view of a second end of the second embodiment of my water craft.
Figure 17:
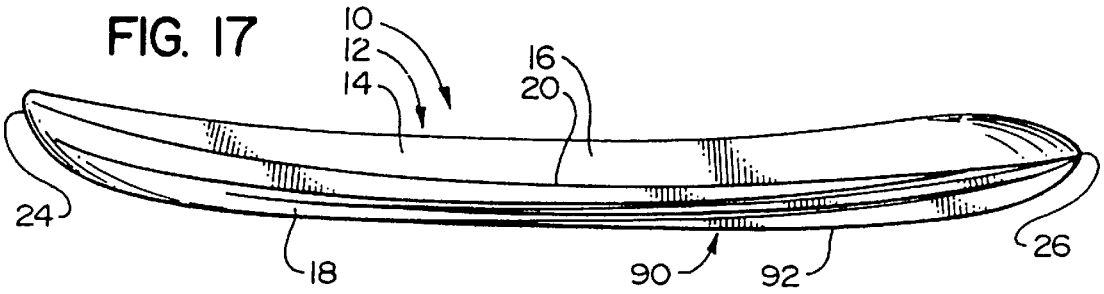
FIG. 17 is a side elevational view of the third embodiment.

Referring initially to FIGS. 14–20 of the drawing, depicted therein at 10 is a sit-on-top kayak constructed in accordance with, and embodying, the principles of the present invention.

The kayak 10 has a hull 12 defining a hull outer surface 14. The hull outer surface 14 has an upper portion 16 and a lower portion 18 separated by a parting line 20 extending around the perimeter of the kayak 10 above the water line. The hull 12 has a bow 24 and a stern 26. The kayak 10 further comprises a cockpit area 28.

Within the cockpit area 28 are first, second, and third seating surfaces 30, 32, and 34. Also in the cockpit area 28 are first, second, and third footwells 36, 38, and 40.

The first seating area 30 is located generally adjacent to the stern 26 of the kayak 10 and will be referred to as the aft seating surface. The second seating surface 32 is located forward of the aft seating surface 30 and will be referred to as the middle seating surface. The third seating surface 34 is the forwardmost of the three seating surfaces and will be referred to as the forward seating surface.

The footwell 36 is associated with the aft seating surface 30 and will be referred to as the aft footwell. The footwell 38 is associated with the middle seating surface 32 and will be referred to as the middle footwell. Similarly, the third footwell 40 is associated with the forward seating surface 34 and will be referred to as the forward footwell.

Each of the footwells comprises first and second footwell portions. In particular, the forward footwell 36 comprises a first portion 42 and a second portion 44. The middle footwell 38 comprises a first portion 46 and a second portion 48. The forward footwell 40 comprises a first portion 50 and a second portion 52.

The middle seating surface 32 is arranged between the first and second aft footwell portions 42 and 44. Similarly, the forward seating surface 34 is arranged between the first and second middle footwell portions 46 and 48.

By separating the footwells into first and second portions and arranging a seating surface between these footwell portions, it is possible to place three seating surfaces in the boat 20 and still have the length of the boat 20 from the bow 24 to the stern 26 be practical.

The kayak 10 further comprises first, second, and third hatch surfaces 54, 56, and 58. Hatches formed in these surfaces 54, 56, and 58 allow access to the interior of the kayak 10, and hatch covers 60, 62, and 64 may be employed to cover the hatches to keep the interior of the kayak 10 dry.

The first hatch surface 54 is arranged between the aft seating surface 30 and middle seating surface 32 and is referred to as the aft hatch surface. The second hatch surface 56 is arranged between the middle seating surface 32 and the forward seating surface 34 and will be referred to herein as the middle hatch surface. The third hatch surface 58 is arranged in front of the forward seating surface 34 and will be referred to as the forward hatch surface. The forward hatch surface 58 is arranged between the first and second forward footwell portions 50 and 52.

Referring now to FIG. 16, it can be seen that the various seating surfaces 34–30 and hatch surfaces 54–58 are arranged in the following sequence from stern 26 to bow 24: aft seating surface 30; aft hatch surface 54; middle seating surface 32; middle hatch surface 56; forward seating surface 34; and forward hatch surface 58. Between the forward hatch surface 58 and the bow 54 is a bow upper surface 66.

As shown in FIG. 16, these surfaces 30, 54, 32, 56, 34, 58, and 66 form a seating deck 68 that extends through the middle of the cockpit area 58 and has contours generally matching that of a perimeter wall 70 that extends almost entirely around the cockpit area 28. This seating deck 68 divides the footwells 36, 38, and 40 into the footwell portions 42–52 as described above.

The seating surfaces 30, 32, and 34 are slightly concave or contoured to provide a more comfortable seating area. The hatch surfaces 54, 56 and 58 are generally planar, although they are necessarily parallel with each other or horizontally aligned.

The footwell portions 42–52 briefly described above are shaped to allow the kayaker to brace his or her feet while paddling. In particular, each of the footwell portions 42–52 comprises a plurality of upwardly and forwardly slanted bracing surfaces such as those shown at 72 and 74 in FIG. 16. Spaced immediately behind each of these bracing surfaces 72 and 74 is a resting surface 76 and 78, respectively. The back of the kayaker's heel will rest on the resting surfaces 76 and 78, while the bottom of the kayaker's feet will engage the bracing surfaces 72 and 74.

Each of the footwell portions 42, 44, 50, and 52 of the forward and aft footwells 36 and 40 comprises four bracing surfaces such as the surfaces 72 and 74 and two resting surfaces such as the resting surfaces 76 and 78. The footwell portions 46 and 48 of middle footwell 38 each comprise only two bracing surfaces 72 and 74 and two resting surfaces 76 and 78.

Each of the footwell portions 46 and 48 of the middle footwell 38 additionally comprises a forwardly and downwardly slanted rear surface such as the surface 80 identified in FIG. 16. These rear surfaces 80 are forwardly and downwardly slanted to allow the kayaker sitting on the middle seating surface 32 to place his or her feet on one of the resting surfaces 76 and 78 without the back of the kayaker's leg rubbing against any surface of the kayak 10.

The footwell portions 42 and 44 of the first footwell 36 and portions 46 and 48 of the second footwell 38 are generally parallel to each other. The footwell portions 50 and 52 of the forward footwell 40 are inwardly canted towards each other such that the hatch surface 58 therebetween is generally triangular or ogival in overall shape.

The seating deck 68 described above on which the seating surfaces 30, 32, and 34 are formed and which extends between the footwell portions 42–48 of the footwells 36, 38, and 40 provides a comfortable seating area for three kayakers, yet still allows the kayakers to rest and brace their feet in a comfortable manner during kayaking.

Referring now to FIGS. 15 and 16, it can be seen that the kayak 10 further comprises four drain holes 82, 84, 86, and 88 that extend between the cockpit area 28 and the underside of the kayak 10. These drain holes 82–88 are located at the juncture of the rearmost resting surface and bracing surface in the footwell portions 42–48 of the aft and middle footwells 36 and 38. The footwell portions 42–48 are configured such that water therein will drain into the drain hulls 82–88 during normal use of the kayak.

Referring now to FIGS. 15 and 17–20, shown therein is a keel structure 90 that is designed to help the kayak 10 track in a straight line when desired, allow the kayak 10 to be turned easily when desired, yet creates a stable kayak that exhibits low resistance during use.

In particular, the keep structure 90 extends downwardly from the hull 12. The keel structure 90 comprises a keel 92 and first and second winglets 94 and 96. The keel 92 is defined by a keel bottom surface 98 and first and second keel side surfaces 100 and 102. The first winglet 94 has a winglet bottom surface 104 and a first winglet outer surface 106. Similarly, the second winglet 96 has a second winglet bottom surface 108 and a second winglet outer surface 110.

Figure 18:
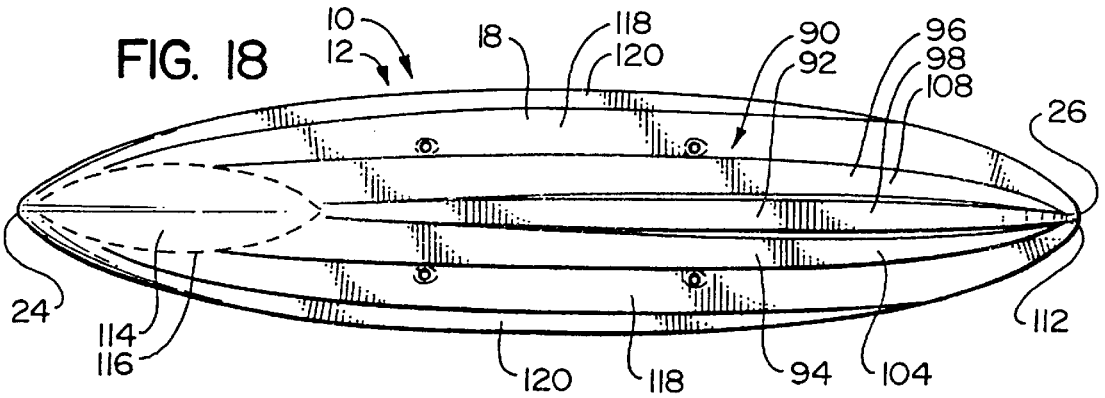
FIG. 18 is a bottom plan view of the third embodiment.
Figure 19:
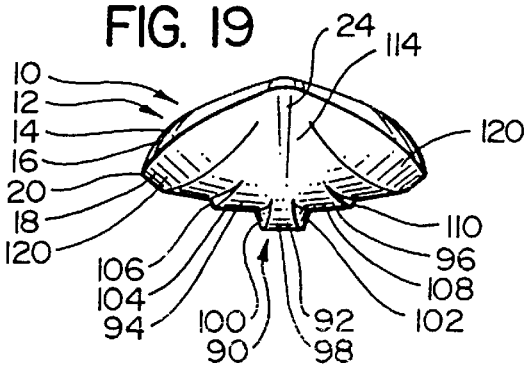
FIG. 19 is an elevational view of a first end of the third embodiment of my water craft.
Figure 20:
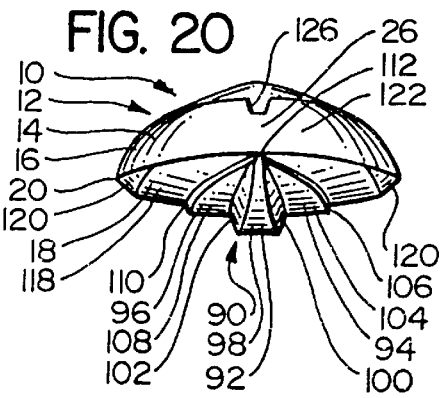
FIG. 20 is an elevational view of a second end of the third embodiment of my water craft.

The keel and winglet bottom surfaces 98, 104, and 108 are smoothly and continuously curved from the stern 26 towards the bow 24 of the kayak 10. In particular, as shown in FIG. 18, these surfaces terminate at a point 112 adjacent to the stern 26 and at a bow hull portion 114 of the hull lower surface 18 adjacent to the bow 24. The bow hull surface portion 114 is generally circumscribed by a dashed line 116 in FIG. 18.

The keel 92 and first and second winglets 94 and 96, like the keel and winglet lower surfaces 98, 104, and 108, terminate at the rear at the point 112 and towards the front of the kayak at the bow hull surface 114. It can be seen from FIG. 18 that the keel structure 90 does not extend along the entire underside of the hull 12. To the contrary, it terminates approximately ⅔ to ¾ of the way from the stern 26 to the bow 24 of the kayak 10.

The keel structure as described above has several unique properties. First of all, the keel 92 extends into the water when the kayak is in use to provide improved tracking. However, because it does not extend the entire length of the kayak, the keel 92 allows the kayak 10 to be easily turned, which increases the maneuverability of the kayak 10.

The winglets 94 and 96 create a structure that almost acts like a narrow kayak hull underneath the kayak hull 12. Thus, when the kayak 10 is lightly loaded, only the keel 92, first winglet 94, and second winglet 96 will engage the water. This effectively narrows the width of the kayak 10 that is in contact with the water and thus lowers the resistance under such lightly loaded conditions. If larger loads are placed in the kayak (i.e., one person on each of the seating surfaces 30, 32, and 34). The entire keel structure 90, including the winglets 94 and 96, will be submerged and the water will engage the hull surface 118. This will result in increased resistance but improved stability of the kayak 10.

The hull 12 further comprises beveled surfaces 120 formed along the bottom surface 18 thereof. These beveled surfaces 120 extend from the bow hull bottom surface portion 114 almost to the stern 26. These surfaces 120 are upwardly and outwardly canted and normally will not engage the water to create resistance to travel but will engage the water under heavy or unevenly distributed loads, resulting in a more stable craft.

The upper surface 16 of the hull 12 is smoothly contoured from the parting line 20 up to the perimeter wall 70 defining the cockpit area 28. The perimeter wall 70 extends substantially around the cockpit area, although a notch 126 is formed in the perimeter wall 70 adjacent to the stern 26. The entire cockpit area 28 is shifted slightly towards the bow of the kayak 10 to provide a more stable distribution of weight therein.

From the foregoing, it should be clear that the present invention may be embodied in forms other than those described above. For example, shown in FIGS. 1–6 and 7–13 are alternative embodiments of the present invention that, while not optimized as is the embodiment shown in FIGS. 14–20, still yield certain of the benefits of the craft 20 shown in FIGS. 14–20.

More particularly, shown at 210 in FIGS. 1–6 is another kayak embodying the principles of the present invention. This kayak 210 has a cockpit area in which is formed an elongate seating deck 212 arranged between first and second footwell portions 214 and 216.

Depicted at 310 in FIGS. 7–13 is a similar kayak in which a seating deck 312 is arranged between first and second footwell portions 314 and 316. This kayak 310 further comprises a keel structure 318 that extends from a point adjacent to a stern 320 of the kayak 310 towards a bow 322 thereof. The keel structure 318 terminates in a bow hull lower surface 324 located adjacent to the bow 322.

Accordingly, the present invention may be embodied in other forms without departing from the scope thereof. The above described embodiment is therefore to be considered in all respects illustrative and not restrictive, the scope of the invention being indicated by the appended claims rather than the foregoing description. All changes that come within the meaning and scope of the claims are intended to be embraced therein.

What is claimed is:

1. A sit-on-top kayak comprising:

a hull defining a hull outer surface, the hull having a first end and a second end longitudinally spaced from the first send;

a cockpit area between the first and second ends and having first and second transverse sides, the cockpit area including:

a first seating surface;

a second seating surface longitudinally spaced from the first seating surface;

a first footwell comprising first and second footwell portions, where the first and second footwell portions are arranged on the first and second transverse sides of the cockpit area, respectively, transversely straddling the second seating surface.

2. The kayak of claim 1 wherein the second seating surface is contoured.

3. The kayak of claim 2 wherein the first seating surface is contoured.

4. The kayak of claim 1 including a deck in the cockpit area, the deck being integrally formed as a single unitary body with the hull.

5. The kayak of claim 4 wherein the deck is shaped to provide the first and second seating surfaces.

6. The kayak of claim 4 wherein the first and second seating surfaces are integrally formed as part of a single unitary body with the deck.

7. The kayak of claim 1 wherein the second seating surface is integrally formed as part of a single unitary body with the hull.

8. The kayak of claim 1 wherein the first and second footwell portions are integrally formed as part of a single unitary body with the hull.

9. The kayak of claim 1 in which the cockpit area further comprises a third seating surface and a second footwell comprising third and fourth footwell portions, where the third and fourth footwell portions are arranged on the first and second transverse sides of the cockpit area, respectively, transversely straddling the third seating surface.

10. The kayak of claim 9 wherein the third and fourth footwell portions are integrally formed as part of a single unitary body with the hull.

11. The kayak of claim 1 wherein the first and second footwell portions each include at least one resting surface.

12. The kayak of claim 1 wherein the first and second footwell portions each include at least one bracing surface.

13. The kayak of claim 10 wherein the first and second footwell portions each include at least one bracing surface.

14. The kayak of claim 11 wherein the first and second footwell portions comprise a plurality of resting surfaces arranged in a longitudinal row.

15. The kayak of claim 1 including non-footwell portions longitudinally extending between the footwell portions of the first and second footwells.

16. The kayak of claim 10 including non-footrest portions longitudinally extending between the footwell portions of the second and third footwells.

17. The kayak of claim 1 including a hatch between the first seating surface and the second seating surface.

18. The kayak of claim 17 wherein the hatch is planar.

19. The kayak of claim 1 wherein the kayak is integrally formed as a single unitary body.

20. The kayak of claim 1 including a third seating surface longitudinally spaced from the first and second seating surfaces.

21. The kayak of claim 20 wherein the first seating surface comprises an aft seating surface, wherein the second seating surface comprises a middle seating surface, and wherein the third seating surface comprises a forward seating surface.

22. The kayak of claim 21 including a third footwell comprising fifth and sixth footwell portions on the first and second sides, respectively, longitudinally spaced from the third seating surface.

23. A sit-on-top kayak comprising:

a hull defining a hull outer surface, the hull having a first end and a second end longitudinally spaced from the first end;

a first seating surface;

a second seating surface longitudinally spaced from the first seating surface; and a first pair of footwell portions transversely straddling the second seating surface.

24. The kayak of claim 23 including:

a third seating surface; and a second pair of footwell portions transversely straddling the third seating surface.

25. A sit-on-top kayak comprising:

a hull having a stern end and a bow end longitudinally spaced from the stern send and a cockpit area between the stern and bow ends; and the cockpit area including first and second discrete seating surfaces arranged between the stern and bow ends of the hull, a spacing surface arranged between the first and second discrete seating surfaces, and a first footwell, where the first footwell is associated with the first seating surface and straddles the second seating surface.

26. A sit-on-top kayak as recited in claim 25, where the cockpit area further includes a third discrete seating surface, a second spacing surface, and a second footwell, where second spacing surface is arranged between the second and third discrete seating surfaces and the second footwell is associated with the second seating surface and straddles the third seating surface.

27. A sit-on-top kayak as recited in claim 26 where the cockpit area further comprises a third footwell, where the third footwell is associated with the third seating surface and is spaced between the third seating surface and the bow end of the hull.

* * * * *